United States Patent [19]

de la Burde et al.

[11] 3,982,550

[45] Sept. 28, 1976

[54] PROCESS FOR EXPANDING TOBACCO

[75] Inventors: Roger Z. de la Burde, Powhatan; Patrick E. Aument, Hopewell, both of Va.; Ray F. Dawson, Princeton, N.J.; Ronald A. Tamol, Richmond, Va.

[73] Assignee: Philip Morris Incorporated, New York, N.Y.

[22] Filed: June 5, 1975

[21] Appl. No.: 583,888

[52] U.S. Cl. ..... 131/140 P

[51] Int. Cl.[2] ..... A24B 3/18

[58] Field of Search ..... 426/385; 34/5, 90, 91, 34/92; 62/62, 63, 64; 131/133–136, 140–144

[56] References Cited

UNITED STATES PATENTS

| | | | |
|---|---|---|---|
| 3,131,700 | 5/1964 | Radwan | 131/140 A |
| 3,710,803 | 1/1973 | Johnson | 131/133 A X |
| 3,749,103 | 7/1973 | Abbot et al. | 131/136 |

FOREIGN PATENTS OR APPLICATIONS

| | | | |
|---|---|---|---|
| 738,726 | 8/1943 | Germany | 131/140 P |

OTHER PUBLICATIONS

"Freeze-Drying Foodstuffs" edited by Cotson and Smith, Based on A Symposium at the Borough Polytechnic London, May 15, 1964.

*Primary Examiner*—Robert W. Michell
*Assistant Examiner*—V. Millin

[57] ABSTRACT

This disclosure relates to a process for expanding tobacco which comprises the steps of (1) subjecting tobacco, preferably in cut or particulate form, to a vacuum, (2) contacting the tobacco, while under vacuum, with water, preferably as a mist or spray, to impregnate the tobacco with water, (3) freezing the water-impregnated tobacco while it is maintained under vacuum, and (4) rapidly heating the frozen water-impregnated tobacco, preferably by direct contact with superheated steam. The first three steps may be, and preferably are, conducted in the same chamber. The fourth step may be conducted in a heating or drying chamber or tower, in a cyclone dryer or in similar equipment which will provide good gas-particle contact.

1 Claim, No Drawings

PROCESS FOR EXPANDING TOBACCO

BACKGROUND OF THE INVENTION

It has long been a goal in the tobacco art to find methods of expanding tobacco in order to increase the bulk or volume of the tobacco. There have been various reasons for expanding tobacco. One of the early purposes for expanding tobacco involved making up the loss of weight of the tobacco which occurred during the curing process. Another purpose was to improve the smoking characteristics of particular tobacco components, in particular, tobacco stems. It has also been desired to increase the filling power of tobacco so that a smaller amount of tobacco would be required to produce a smoking product, such as a cigarette, which would have the firmness and yet would produce lower tar and nicotine than the comparable smoking product made of non-expanded tobacco having a more dense tobacco filler.

Various methods have been proposed for expanding tobacco, including the impregnation of tobacco with a gas under pressure and the subsequent release of the pressure, whereby the gas causes expansion of the tobacco cells to increase the volume of the treated tobacco. Other methods which have been employed or suggested for the expansion of tobacco relate to the treatment of tobacco with various liquids, such as water or relatively volatile organic liquids, to impregnate the tobacco with the same, after which the liquids are volatilized to expand the tobacco. Additional methods which have been suggested relate to the treatment of tobacco with solid materials which, when heated, decompose to produce gases which serve to expand the tobacco. Other methods relate to the treatment of tobacco with gas-containing liquids, such as carbon dioxide-containing water, under pressure, to incorporate the gas in the tobacco, after which the tobacco impregnated therewith is heated or the pressure thereon is reduced to thereby expand the tobacco. Other methods have been suggested for expanding tobacco involving the treatment of tobacco with gases which react to form solid chemical reaction products within the tobacco, after which the solid reaction products may be decomposed by heat to produce gases within the tobacco which cause expansion of the tobacco upon their release. Illustrative of the art relating to tobacco expansion are the following:

U.S. Pat. No. 1,789,435, granted in 1931 to Wilford J. Hawkins, which describes a method and apparatus for expanding the volume of tobacco in order to make up the loss of weight caused in curing tobacco leaf. To accomplish this object, the cured and conditioned tobacco is contacted with a gas, which may be air, carbon dioxide or steam under pressure and the pressure is then relieved, whereby the tobacco tends to expand. The patent states that the volume of the tobacco may, by that process, be increased to the extent of about 5–15 percent.

Alien Property Custodian document No. 304,214 to Hoachim Bohme, dated 1943, indicates that tobacco can be expanded using a high frequency generator but that there are limitations to the degree of expansion which can be achieved without affecting the quality of the tobacco.

A patent to Frank J. Sowa, U.S. Pat. No. 2,596,183, granted in 1952, sets forth a method for increasing the volume of shredded tobacco by adding additional water to the tobacco to cause the tobacco to swell and thereafter heating the moisture containing tobacco, whereby the moisture evaporates and the resulting moisture vapor causes expansion of the tobacco.

A series of patents to Roger Z. de la Burde, one of the present coinventors, granted in 1968, specifically U.S. Pat. Nos. 3,409,022, 3,409,023, 3,409,027 and 3,409,028, relate to various processes for enhancing the utility of tobacco stems for use in smoking products by subjecting the stems to expansion operations utilizing various types of heat treatment or microwave energy.

A patent to John D. Hind, granted in 1969, U.S. Pat. No. 3,425,425, which is assigned to the same assignee as the assignee of the present invention, relates to the use of carbohydrates to improve the expansion of tobacco stems. In that process, tobacco stems are soaked in an aqueous solution of carbohydrates and then heated to puff the stems. The carbohydrate solution may also contain organic acids and/or certain salts which are used to improve the flavor and smoking qualities of the stems.

A publication in the "Tobacco Reporter" of November 1969 by P. S. Meyer relates to the art, as of that date, pertaining to tobacco puffing or expansion procedures or investigations for expanding and manipulating tobacco for purposes of reducing costs and also as the means for reducing the "tar" content by reduction in the delivery of smoke. Mention is made in this publication of puffing tobacco by different procedures including the use of halogenated hydrocarbons, low pressure or vacuum operation, or high pressure steam treatment that causes leaf expansion from inside the cell when outside pressure is suddenly released. Mention is also made in this publication of freeze-drying tobacco which can also be emloyed to obtain an increase in volume.

Since the above-mentioned Tobacco Reporter article was published, a number of tobacco expansion techniques, including some of the techniques described in the article, have been described in patents and/or published patent applications. For example:

U.S. Pat. No. 3,524,452 to Glenn P. Moser et al. and U.S. Pat. No. 3,524,451 to James D. Frederickson, both issued in 1970, relate to the expansion of tobacco using a volatile organic liquid, such as a halogenated hydrocarbon.

U.S. Pat. No. 3,734,104 to William M. Buchanan et al., which is assigned to the same assignee as the assignee of the present invention, issued in 1973, relates to a particular process for the expansion of tobacco stems.

U.S. Pat. No. 3,710,803 to William H. Johnson, issued in 1973 and British Specification No. 1,293,735 to American Brands, Inc., published in 1972, both relate to freeze drying methods for expanding tobacco.

South African application Nos. 70/8291 and 70/8282 to R. J. Reynolds Tobacco Company, both issued in 1970, relate to tobacco expansion employing chemical compounds which decompose to form a gas or with inert solutions of a gas under pressure to maintain the gas in solution until it impregnates the tobacco.

U.S. Pat. No. 3,771,533, issued in 1973 to Robert G. Armstrong et al., which is assigned to the same assignee as the assignee of the present invention, involves a treatment of tobacco with carbon dioxide and ammonia gases, whereby the tobacco is saturated with these gases and ammonium carbonate is formed in situ. The ammonium carbonate is thereafter decomposed by heat to release the gases within the tobacco cells and to cause expansion of the tobacco.

The use of special expanding agents, for example, halogenated hydrocarbons, such as are mentioned in the Meyer publication for expanding tobacco, is also not completely satisfactory because these substances are generally required to volatilize or remove the substances after the tobacco has been expanded. The introduction, in considerable concentration, of materials which are foreign to tobacco presents the problems of removing the expansion agent after the treatment has been completed in order to avoid affecting aroma and other properties of the smoke due to extraneous substances used or developed from the combustion of the treated tobacco.

The use of solid chemicals to produce a gas upon decomposition has not been found satisfactory, perhaps due to the fact that the chemicals cannot be incorporated in the cells of the tobacco.

The use of carbonated water has also not been found to be effective.

The present process has been found to overcome many of the disadvantages of the prior art processes and to provide an improved method for expanding tobacco, which employs water as the expanding medium.

One goal of workers in the art has been to cause substantial expansion of tobacco by employing water, alone, as the expansion method. The use of water, if it could be employed successfully, would have the advantage of incorporating no elements in the tobacco which could be used undesirably and of incorporating in the tobacco a degree of residual moisture which can be employed to satisfy the normal requirements, with respect to the degree of moisture employed in tobacco products. In general, the attempts which have been made to expand tobacco leaf with water, for example, by rapid heating or by sudden reduction of pressure, have not provided a permanent, usefully large degree of increase in volume. For example, the disclosure in U.S. Pat. No. 1,789,435 to Hawkins relates to the exposure of tobacco to high pressure steam, followed by sudden pressure release. The result has been found to consist of a poor quality tobacco with excessive breakage, and the volume increase is only 5 to 15 percent. Some processes involve alternate evacuation and steaming or moistening of tobacco but truly significant expansion has not been found to result from these. One of the present coinventors, de la Burde, has expanded tobacco stems with moisture alone (as described in U.S. Pat. Nos. 3,409,022; 3,409,023; 3,409,027 and 3,529,606) but the procedure has been found to have little effectiveness with leaf. Another technique which has been described is set forth in U.S. Pat. No. 3,710,803 to W. H. Johnson. This process, which was disclosed at the 23rd Tobacco Chemists Research Conference in October 1969, involves the expansion of tobacco by turgor conditioning followed by freeze drying. In accordance with the Johnson process, moisture content of the tobacco is brought to a level of 80 to 90 percent, by weight, before the freeze drying step, by evacuating the tobacco to remove air and water vapor, admitting liquid water to cover the tobacco while vacuum is maintained, then raising the pressure to atmospheric or above to drive the water rapidly into and between the cells. Johnson's sublimation drying is then carried out at a temperature of less than 32°F. The Johnson process has been found to be of limited usefulness, in terms of commercial process, due to its inherent long processing time and its high cost, particularly in the drying step. In addition, the structure of the swollen tobacco produced by the process has been found to be subject to collapse due to the fact that when the water is not in solid form, during vacuum release, there is inadequate support for the swollen structure of the tobacco. Furthermore, the Johnson process can result in wash out or redistribution of water solubles. Thus, despite all of the above-described teachings, no completely satisfactory process has been found for the expansion of tobacco, whereby significant expansion can be obtained without the use of elaborate and expensive equipment and without the necessity for high operating costs.

SUMMARY OF THE INVENTION

This disclosure relates to a process for expanding tobacco which comprises the steps of (1) subjecting tobacco, preferably in cut or particulate form, to a vacuum, (2) contacting the tobacco, while under vacuum, with water, preferably as a mist or spray, to impregnate the tobacco with water, (3) freezing the water-impregnated tobacco while it is maintained under vacuum, and (4) rapidly heating the frozen water-impregnated tobacco, preferably by direct contact with superheated steam at ordinary pressures. In more detail:

Step (1) preferably comprises subjecting tobacco, preferably in cut form, to a vacuum of from about 15 to about 30 inches of mercury at a temperature of from about 16 to about 27°C., whereby air is removed from the tobacco.

Step (2) preferably comprises treating the tobacco, while still under vacuum of from about 15 to about 30 inches of mercury, with water, preferably as a spray, to introduce from about 65 to about 80 percent by weight moisture in the tobacco.

Step (3) preferably comprises freezing the water-impregnated filler, by cooling it to a temperature low enough to insure complete freezing of the moisture, while it is maintained under vacuum, and Step (4) preferably comprises rapidly heating the frozen moisture-containing tobacco, for example, by direct contact with steam at a temperature of from about 120°C. to about 320°C. for a period of from about 0.5 to about 12 seconds.

The first three steps may be and preferably are conducted in the same chamber. The fourth step may be conducted in a heating or drying chamber or tower, in a cyclone dryer or in similar equipment which will provide good gas-particle contact.

DETAILED DESCRIPTION OF THE INVENTION

The present invention relates, broadly to a process for expanding tobacco which employs water as the expansion agent. More particularly, the present invention relates to a process for the production of an expanded tobacco product of substantially reduced density produced by subjecting tobacco to a vacuum, impregnating the tobacco, while under vacuum, with water, freezing the water-impregnated tobacco while it is maintained under vacuum, and thereafter rapidly heating the frozen water-containing tobacco to cause expansion.

To carry out the process of the invention, one may treat either whole cured tobacco leaf, tobacco in cut or chopped form, for example in the form generally employed as cigarette filler, or selected parts of tobacco such as tobacco stems. In comminuted form, the tobacco to be impregnated may have a particle size of from about 10 to about 50 mesh, and preferably not less than about 30 mesh. The material treated may be in relatively dry form, or may contain the natural moisture content of tobacco or even greater amounts of moisture. Generally, the tobacco to be treated by the process will contain from about 8% moisture, by weight, to about 25 percent, by weight, of moisture.

In accordance with the present process, the tobacco is placed in a suitable vessel in which a vacuum may be drawn and which is equipped with means for applying water, for example, by means of vacuum suction or water and/or pressure injection of steam and which may also be equipped with means for rotating or agitating the vessel or its contents.

After the tobacco has been placed in the vessel, a vacuum is drawn in the vessel, preferably to a level of from about 15 to about 30 inches of mercury. This is generally done at ambient temperature, but may be at a temperature of from 0° to 80°C. Water is then introduced into the vessel, preferably in the form of a fine mist or spray until the moisture content of the tobacco has been brought to the level of from about 65 to about 80 percent, by weight. The resulting water-containing tobacco is preferably subjected to agitation, by means of rotation of the vessel or by other known agitation methods, in order to assure uniform distribution of the water in the tobacco. The water-containing tobacco is then permitted to stand for a period of at least 10 minutes and preferably for a period of from about 15 minutes to about 60 minutes, in order to permit the tobacco and moisture to equilibrate within and between tobacco fibers. Longer standing times may be employed, but are generally not necessary.

After the tobacco and moisture have been permitted to equilibrate, which has been found to cause a decrease in the vacuum pressure of from about 2 to 3 inches of mercury, the moisture-tobacco mixture is brought, by a suitable cooling of the vessel, to a temperature low enough to insure complete freezing of the water in the tobacco. The mixture is maintained at that level for a period long enough to insure the complete conversion of substantially all the water in the water-swollen tobacco to ice. To accomplish this, the mixture is preferably brought to a temperature of from about −60° to 0°C., preferably −30° to −10°C. and maintained within those limits for a period of from 3 to 120 minutes, preferably 10 to 30 minutes.

After the water has been converted to ice in the tobacco, the vacuum may be released. After the filler has been properly impregnated and frozen, the vacuum can be safely released at any desired rate and the swollen tobacco structure is supported by ice crystals formed within it.

The tobacco is passed to a heating zone where it is preferably contacted with steam or a steam/hot gas mixture maintained at a temperature of from about 120° to about 320°C. This contact, which should be intimate, "sets" the ice stabilized structure and removes water in as short a time as possible, generally in about 0.5 to about 12 seconds of contact time. The tobacco particles, preferably, should be passed through a turbulent heating zone in order to tumble and separate them. The temperature of the steam or hot gas in contact with the impregnated filler should be from about 120° to 320°C., and preferably from about 150° to about 235°C., preferably for a period of from about 3 to about 6 seconds. Obviously, the longer contact times apply to the lower gas temperatures and care should be taken to prevent tobacco charring. This expansion/heating step may be conducted in a rotary cyclone or other high turbulence unit.

The filling capacity of the filler has been found to be increased by the present process from about 35–39 cc/10 g to about 50–70 cc/10 g.

In measuring and determining filling capacity, the standard procedure used comprises filling a graduate cylinder with a selected amount of tobacco filler. The filler is compressed under a mass at 2.8 psi for approximately 5 minutes. The units of measurement are read directly from the graduate scale in cc/10 g of sample and reported as cylinder volume, or C.V. This pressure of 2.8 psi has been found to be comparable to the processes involved in conventional methods of producing a tobacco rod on a cigarette maker. Since moisture affects the filling capacity, samples of expanded and control material are tested at a comparable moisture content, specifically, with a moisture content of 10–13 percent.

The following examples are illustrative:

EXAMPLE 1

10 ounces of cut bright tobacco, cut in the form of commercial cigarette filler, was placed in a 1 lb. vacuum vessel (made by Buffalo Dental Co.). The unit was equipped with a vacuum and release port and gauges. A vacuum was drawn to 25 inches of mercury. The tobacco was impregnated at a temperature of 6°C. with about 20 ounces cold water by vacuum suction, until the moisture content of the tobacco was at 66 percent by weight. The impregnation took about 5 minutes. Even distribution of water was insured by end-to-end rotation of the vacuum vessel during wetting. The entire vacuum vessel was then placed in an acetone-dry ice bath to bring the temperature of the tobacco mixture to −10°C. A vacuum was drawn to 30 inches of mercury. The mixture was permitted to equilibrate for 1 hour, after which the vacuum was broken. This was done by opening the release port. The resulting material was then removed from the vacuum vessel and passed through a rotary cyclone type dryer maintained at a temperture of 218°C. and with a 100 percent steam atmosphere. Residence time in the dryer was 8 seconds. The expanded filler was reordered to a level of from 6.1 to 12 percent moisture. The final product was found to have a filling power (cylinder volume) of 53 cc/10 g, compared with a control of 38 cc/10 g.

EXAMPLES 2–5

Four samples (10 ounces each) of bright cut tobacco were separately treated as follows: each sample was placed in a 1 lb. vacuum vessel as described in Example 1. Vacuum was drawn to 25 inches of mercury. The filler samples were impregnated with cold water as in Example 1, with, respectively 50, 67, 75 and 80 percent moisture by vacuum suction. In each case, the vacuum vessel was placed in an ice-sodium chloride bath (about −27°C.) and a vacuum was drawn to 30 inches of mercury in each run. In each case, after a one hour equilibration period, the vacuum was broken and the sample was passed through a rotary cyclone dryer at 218°C. and 100 percent steam atmosphere. Residence time was varied according to the moisture content, as set forth in Table I. Table I shows the results of the different runs:

| Example | Moisture O.V.,% | Dryer Residence Time | Filling Power C.V., cc/10 g | Moisture % | Reordered Filling Power | Hot Water Solubles % |
|---|---|---|---|---|---|---|
| 2 | 50 | 4 seconds | 58 | 10.2 | 41 | 57.6 |
| 3 | 67 | 8 seconds (2 passes at 4 secs. each | 74 | 9.7 | 53 | 52.8 |
| 4 | 75 | 8 seconds (2 passes at 4 secs. each) | 76 | 10.3 | 70 | 52.7 |
| 5 | 80 | 12 seconds (3 passes at 4 secs. each) | 82 | 9.7 | 73 | 48.8 |
| Control 12 | | | | | 36 | 57.2 |

It will be seen from Table I, that, as the moisture content is raised, the filling power increases when other expansion parameters are unchanged. These data also show that the analyzed loss of "hot water solubles" is low. This "loss" would appear to be due to chemical changes during expansion, rather than "washing out" of the solubles. Therefore, the observed filling power gain can be taken as not due to removal of solubles but due to the true expansion and change in the elastic properties of the fibers.

EXAMPLE 6

Two series of 20 lb. samples were impregnated in a large ball type vacuum vessel. In the first series a vacuum of 30 inches of mercury was drawn and cold water was introduced into the vessel. Following the water addition of 30 to 80 percent moisture, the swollen filler structure was set for forming ice. This was accomplished by passing chilled ethylene glycol-water solution (50-50) through the wall of the impregnator at a temperature of about −30°C. Following an equilibration period of 2 hours (vacuum 28 in., temperature 28°F.), the vacuum was gradually released. The samples were then passed through a cyclone dryer at 260°C. The second series was identical except that no freezing step was used and the equilibration period was at ambient temperature conditions (70°F.).

Both the frozen and unfrozen water impregnated filler were heated as described in Examples 2, 3, 4 and 5.

Table II shows the results of the different runs:

Table II

| FROZEN Sample | 1 | 2 | 3 | 4 | 5 |
|---|---|---|---|---|---|
| Impregnated Moisture % | 30 | 50 | 67 | 75 | 80 |
| Product Moisture % After Drying | 9.5 | 11.5 | 7.5 | 7.3 | 7.0 |
| Filling Power Product, cc/10 g | 49 | 42 | 70 | 75 | 82 |
| Residence Time, Seconds | 4 | 4 | 8 | 8 | 12 |
| Filling Power (reordered) to 12%, cc/10 g | 39 | 40 | 52 | 58 | 62 |
| **UNFROZEN Sample** | **6** | **7** | **8** | **9** | **10** |
| Impregnated Moisture % | 30 | 50 | 67 | 75 | 80 |
| Product Moisture % | 6.2 | 7.0 | 5.2 | 6.2 | 3.2 |
| Filling Power Product, cc/10 g | 63 | 66 | 70 | 67 | 87 |
| Residence Time, Seconds | 4 | 4 | 8 | 8 | 12 |
| Filling Power (reordered) cc/10 g | 39 | 36 | 42 | 43 | 43 |

The data shows that the reordered filling power of the filler which swollen structure was stabilized by ice formation before breaking the vacuum and heat setting the structure was much higher than the reordered filling capacity of the "unfrozen" material. This indicates that the freezing step is necessary to obtain maximum expansion in this process.

EXAMPLE 7

Twenty pound samples were produced in the large ball type unit as described in Example 6 (frozen samples). Thickness measurements of the impregnated samples were made. The samples were expanded as described previously. Table III shows the results of the different runs:

Table III

| Sample | 11 | 12 | 13 | 14 | Control |
|---|---|---|---|---|---|
| Moisture % | 50 | 67 | 75 | 80 | 12 |
| Thickness (microns) | 103 | 107 | 204 | 204 | 100 |
| Reordered Filling Power, cc/10 g | 38 | 42 | 52 | 58 | 38 |

The data show the highly swollen samples have the greatest degree of expansion and that no appreciable swelling takes place until 67 percent moisture. The expansion was assured by ice stabilizing of the swollen structure which normally collapses on gradual vacuum release. The heating step retains the set structure while reducing the moisture content.

Experiments A and B

The following experiments were conducted to provide a comparison between an expansion process involving freeze-drying (Method A) and the process of this invention (Method B) and with a control, the same type of tobacco which had not been subjected to an expansion process.

A. One pound of cured bright tobacco filler at 14 percent moisture by weight was distributed on a tray and placed in vacuum chamber. The chamber was sealed and evacuated to 29 inches of mercury. Water at 20°C. was metered into the tray by vacuum suction until the tobacco shreds were completely covered. Since the fibers floated to the water surface, it was necessary to use a special wire-screen cover. Ten pounds of water was added during this process. The vacuum was then released, the sample tray withdrawn. Drainage from the tray was measured. The tray was then removed and placed in a commercial freezer for 2 hours. The frozen filler was lyophilized in a separate unit at 0°C. in a commercial freeze drying unit for 24 hours.

b. One pound of cured bright tobacco filler at 14 percent moisture by weight was placed in a vacuum vessel as described above. A vacuum was drawn to 29 inches of mercury. The tobacco was impregnated with 4 lbs. of water at a temperature of 20°C. Without removing the filler, an acetone-drying mixture was passed through the jacket of the vessel (15 min.) until the product was frozen. The vacuum was released and the frozen filler was passed through a rotary cyclone dryer at 425°F. using 100 percent steam atmosphere. Residence time in the dryer was 4 seconds.

| Analytical Results | A | B | |
|---|---|---|---|
| Example | Freeze-drying | Present Method | Control |
| Filling power, cc/10 grams | 60 | 62 | 38 |
| Hot water solubles | 49.8% | 55.2% | 56.4% |
| Amount of water drained off | 2½ lb. | 0 | — |
| **Process Differences** | **A** | **B** | |
| | Freeze Drying with Turgor Conditioning | Present Method | |
| Water/tobacco ratio | 10:1 | 4:1 | |
| Amount of water drained off | 2.5 lbs. | 0 | |
| Time of impregnation and freezing | 4 hrs. | 20 min. | |
| Handling character of tobacco, after removal from vacuum for freezing | poor (wet) | good (frozen) | |
| Ease of removal of product for expansion | equal | equal | |
| **Expansion** | | | |
| (Setting method) | freeze drying | heat | |
| Time of expansion (setting) | 24 hrs. | 5 sec. | |
| Product (filling power) | equal | equal | |
| Physical appearance color | lighter than control | same as control | |
| Total lapsed time | 30 hrs. | 1 hr. | |

What is claimed is:

1. A process for expanding tobacco which comprises the steps of (1) subjecting tobacco to a vacuum of from about 15 to about 30 inches of mercury, (2) contacting the tobacco, while it is maintained under a vacuum of from about 15 to about 30 inches of mercury and a temperature of from about 0°C. to about 80°C., with a water spray to impregnate the tobacco with water to provide a tobacco product having a moisture content of from about 100 to 400 parts by weight per 100 parts of tobacco, (3) freezing said moisture-containing tobacco product by cooling said product to a temperature below 0°C., while maintaining the same under a vacuum of from about 15 to about 30 inches of mercury until substantially all of the moisture contained therein is frozen, and (4) rapidly heating the frozen moisture-impregnated tobacco at a temperature of from about 120°C. to about 320°C. for a period of from 0.5 to about 12 seconds to cause expansion thereof.

* * * * *

UNITED STATES PATENT OFFICE

CERTIFICATE OF CORRECTION

PATENT NO. : 3,982,550

DATED : September 28, 1976

INVENTOR(S) : ROGER Z. DE LA BURDE, PATRICK E. AUMENT, RAY F. DAWSON and RONALD A. TAMOL It is certified that error appears in the above-identified patent and that said Letters Patent are hereby corrected as shown below:

Column 2, line 36, "emloyed" should read --employed--.

Column 2, line 38, "above-mentioned Tobacco Reporter article" should read --above-mentioned "Tobacco Reporter" article--

Column 6, line 47, "temperture" should read --temperature--.

Column 7, Table I, last line, delete "12" under the heading "Example" and enter --12-- under the heading "Moisture O.V.,%".

Column 7, line 59, "was set for" should read --was "set" for--.

Column 8, line 44, "heat setting" should read --heat "setting"--.

UNITED STATES PATENT OFFICE

CERTIFICATE OF CORRECTION

Patent No. 3,982,550 Dated September 28, 1976

Inventor(s) Roger Z. de la Burde, et al

It is certified that error appears in the above-identified patent and that said Letters Patent are hereby corrected as shown below:

Column 8, line 68, "ice stabilizing of" should read --ice "stabilizing" of--.

Signed and Sealed this

Twenty-first Day of June 1977

[SEAL]

*Attest:*

RUTH C. MASON
*Attesting Officer*

C. MARSHALL DANN
*Commissioner of Patents and Trademarks*